US006428406B1

(12) United States Patent
Katsuyama et al.

(10) Patent No.: US 6,428,406 B1
(45) Date of Patent: Aug. 6, 2002

(54) SOFT POLISHING DISC WITH HOLES AND METHOD OF MANUFACTURING THE SAME

(75) Inventors: Tsuneo Katsuyama, Urayasu; Taisei Tsuchiya, Kawaguchi, both of (JP)

(73) Assignee: Kantoseito Co., Ltd. (JP)

( * ) Notice: Subject to any disclaimer, the term of this patent is extended or adjusted under 35 U.S.C. 154(b) by 0 days.

(21) Appl. No.: 09/757,710

(22) Filed: Jan. 11, 2001

(30) Foreign Application Priority Data

Aug. 4, 2000 (JP) ..... 2000-237262

(51) Int. Cl.[7] ..... B24D 11/00
(52) U.S. Cl. ..... 451/526; 451/533
(58) Field of Search ..... 451/526, 527, 451/529, 530, 533

(56) References Cited

U.S. PATENT DOCUMENTS 3,754,359 A * 8/1973 Scandaletos ..... 451/488
3,808,753 A * 5/1974 Maran ..... 51/358
3,932,966 A * 1/1976 Stern ..... 51/356
5,076,024 A * 12/1991 Akagawa et al. ..... 51/209
5,222,333 A * 6/1993 Watanabe et al. ..... 51/401
5,431,596 A * 7/1995 Akita et al. ..... 451/540
5,542,875 A * 8/1996 Ichiguchi ..... 451/533
6,312,325 B1 * 11/2001 Van Osenbruggen ..... 451/548

FOREIGN PATENT DOCUMENTS

JP 3064081 8/1999
JP 2000210875 A * 8/2000 ..... B24D/13/16

* cited by examiner

*Primary Examiner*—Joseph J. Hail, III
*Assistant Examiner*—David B. Thomas
(74) *Attorney, Agent, or Firm*—Parkhurst & Wendel, LLP

(57) ABSTRACT

A soft polishing disc with holes is composed of an abrasive member, which is obtained by radially disposing abrasive pieces each composed of a sand paper having abrasive grains coated on a soft base cloth while partially stacking the abrasive pieces and by coupling them with each other by a thermosetting resin, and ventilation holes are formed through the disc. The soft polishing disc with holes can stably grind and polish a workpiece even if it is soft or hard and has a good air ventilation property, maintains an air cooling effect for a long period of time, is difficult to be loaded with chips, increases the heat radiation property of an abrasive surface and makes it to difficult for a workpiece to be burnt.

15 Claims, 3 Drawing Sheets

SOFT POLISHING DISC WITH HOLES AND METHOD OF MANUFACTURING THE SAME

BACKGROUND OF THE INVENTION AND RELATED ART STATEMENT

The present invention relates to a polishing disc and a method of manufacturing the same. More specifically, the present invention relates to an improved polishing disc that is used by being mounted on a rotary tool such as a grinder or the like to grind and polish a material of steel, non-ferrous metal, stone, wood, ceramics and the like and to a method of manufacturing the same.

Disc type polishing grindstones are mounted on a grinding machine and rotated thereby to grind and to polish a workpiece composed of steel, non-ferrous metal, stone, wood, ceramics and the like, and used by being mounted on a rotary tool such as a grinder or the like. They are widely used in the various fields of industries such as building construction, shipbuilding, engineering works, electric works and the like.

An offset type resinoid grindstone disc, for example, is exemplified as a technology of a conventional grinding and polishing disc. This is a disc composed of a phenol grindstone formed in a disc shape and mainly used for grinding. A workpiece that can be ground thereby is limited only to a little hard material such as cast iron, stainless steel and the like.

The offset type resinoid grindstone disc has bad heat radiation on the grinding surface thereof because it is inferior in air permeability in grinding. Thus, the offset type resinoid grindstone disc has such a problem that burning is caused to a workpiece and that the ability of the disc is reduced because it wears by itself and is loaded with chips ground from the workpiece.

An offset type flexible grindstone disc is a thin disc composed of a glass net reinforced grindstone formed in a disc shape and can be widely applied to cutting, grinding, polishing and the like. The offset type flexible grindstone disc is preferably used in the grinding, polishing and the like of a flat surface because it is excellent in cushioning. However, the flexible grindstone disc has a problem in that it is promptly worn and consumed and loading is caused thereto and that a workpiece is burnt due to the insufficient radiation of the disc while it is used. Further, a material that can be polished and ground by the disc is limited only to steel, cast iron, and stainless steel.

Further, a sand paper type disc, which is constructed such that abrasive pieces each composed of a sand paper having abrasive grains coated on the surface thereof, are radially disposed while being partially stacked, has a similar problem. That is, a workpiece is prevented from being burnt by the good air permeability of the disc at the beginning of use thereof. However, exfoliated abrasive grains and the fiber pieces of the sand paper are sunk into the disc in a short period of time and the disc is loaded therewith, which reduces the ability of the disc as well as the air permeability thereof is deteriorated, and the workpiece is burned due to insufficient radiation. The disc can be used in a relatively wide range of a workpiece such as wood, steel, and stainless steel.

A problem that is commonly arisen in these polishing discs resides in that since they are used by being rotated at a very high speed with respect to a workpiece, the workpiece is burnt by frictional heat of high temperature generated thereby. A reason why this problem is arisen is that a large pressure is applied to the workpiece by the polishing disc when it is polished thereby. To solve this problem, it has been examined to compose the polishing disc of synthetic rubber to ease the contact of the polishing disc with the workpiece. However, since the synthetic rubber ordinarily has small pores, it is loaded with chips that are produced when the workpiece is polished and further it is exfoliated from a base sheet when it is rotated at a high speed because it is badly bonded thereto. Thus, the synthetic rubber cannot be practically used for a long period of time.

Japanese Utility Model Registration No. 3064081 proposes an idea for improving the defect of the synthetic resin. That is, it proposes a polishing disc composed of elastic synthetic resin sheets of urethane that are mixed with abrasive grains and disposed radially so as to form recessed portions. A workpiece is prevented from being burnt by the elasticity of the synthetic resin, and the radial disposition of the recessed portions makes airflow and the air cooling effect of which further prevents the burning of the workpiece by. In addition, a bonding property that withstands high speed rotation can be realized by a cloth held and bonded between the urethane synthetic resin and a base sheet.

However, while the polishing disc is not exfoliated from the base sheet when it is rotated at a high speed in a practical use, an effect of preventing the burning of a workpiece for a long period of time cannot be found because the recessed portions are collapsed and blocked due to the elasticity of the polishing disc. Thus, it cannot be said that the polishing disc has a practically usable ability because an air cooling effect that is realized by the maintenance of air permeability is exhibited for a very short period of time.

A flat disc with holes as shown in FIG. 3 that prevents loading in consideration of air permeability is known. The flat disc with holes 21 is a disc that polishes a workpiece by being mounted on a rotary tool through a shaft hole 24 and rotated at a high speed. The flat disc with holes 21 includes a flat abrasive member 26 formed on a ring portion 27, and ventilation holes 28 are formed through the abrasive member 26 at equal intervals. The ventilation holes 28 exhibit an effect of preventing burning by discharging polished chips and ground chips, maintain air permeability, and dissipating heat.

However, while the radiation property of the polishing disc is improved, the abrasive member 26 is composed of hard aluminum oxide, thus when a workpiece is composed of, for example, stainless steel, it is broken and flown into pieces when the disc is rotated at 5000 rpm or more. Accordingly, the polishing disc cannot be effectively used. Further, the disc has a problem that large noise and vibration are produced in polishing because the abrasive member 26 is hard. Furthermore, while the disc is protected by a pad attached to the back surface thereof for safety, the pad is liable to be broken because the ventilation holes 28 have a large diameter, which prevents the abrasive member 26 from being used until it is perfectly consumed. Thus, the disc is is ineffectively used and an operating cost is increased.

Further, recently, it is required to polish and grind many kinds of workpieces composed of various materials ranging from a very hard material such as cemented carbide, special stainless steel, and the like to a relatively soft material such as aluminum, copper, magnesium, and the like, in addition to that the workpieces have various characteristics. Hard workpieces are liable to be more burnt because they are heated to a high temperature, whereas soft workpieces are liable to cause loading on a disc because chips are produced therefrom in a large amount. In such circumstances, it has been desired to polish and grind a wide range of workpieces with polishing discs the number of which is as small as possible taking workability into consideration.

As described above, the conventional polishing discs have a problem that loading and burning are caused in a short period of time due to an insufficient cooling ability and the ability of the disc is reduced thereby and that loading and burning are further caused because the discs are heated to a high temperature due to insufficient radiation. Moreover, at present, it is required that no loading and burning are caused under the severe polishing and grinding conditions of ultra-high rotation in which a disc is rotated at least 10000 rpm for the improvement of a manufacturing efficiency. Accordingly, there is a large object to be achieved that the above problems must be improved under the above severe conditions with polishing discs the number of which is as small as possible in the polishing and grinding of workpieces the types of which are being further increased.

The inventors proposed an open type reticulated polishing disc and a manufacturing method of the same in Japanese Patent Application No. 2000-107606 to solve the above-mentioned conventional problems, and the present invention is obtained by further studying the above proposal. Accordingly, it is an object of the present invention to provide a soft polishing disc with holes that has a good air ventilation property, maintains an air cooling effect for a long period of time, is difficult to be loaded with chips, increases the heat radiation property of an abrasive surface and makes it to difficult for a workpiece to be burnt and that can stably grind and polish a workpiece even if it is rotated at an ultra-high rotational speed of 10000 rpm or more.

SUMMARY OF THE INVENTION

As a result of various examinations, the inventors have found that the above object can be achieved by providing a soft polishing disc with holes and a method of manufacturing the same, the soft polishing disc with holes being arranged such that an abrasive member is obtained by radially disposing abrasive pieces each composed of a sandpaper, on which abrasive grains are coated, on a flexible base cloth while partially stacking them and by coupling the abrasive pieces with each other through a thermosetting resin, and then ventilation holes are formed through the abrasive member.

That is, according to the present invention, there is provided a soft polishing disc with holes usable for grinding and polishing a workpiece, comprising:

a back sheet mounted on a rotary tool and rotated thereby, and an abrasive member composed of abrasive pieces that are disposed radially on a ring portion having an outside diameter and an inside diameter from the center of the ring thereof and bonded to each other, wherein each of the abrasive pieces is composed of a sand paper, a thermosetting resin is used as a coupling agent for bonding the abrasive pieces with each other, and a plurality of ventilation holes are formed through the abrasive member at predetermined intervals.

In the soft polishing disc with holes of the present invention, it is preferable that the grade of roughness of the sand paper be about #30 to #1000, and it is preferable that the base cloth of the sand paper be composed of cotton or paper which is soft and difficult to be melted by heat.

It is preferable that the thermosetting resin be melamine resin, silicon resin, phenol resin, urea resin that are cured by a polycondensation reaction and be epoxy resin, acrylic resin, etc. that are cured by a polyaddition reaction. It is preferable that the thermosetting resin is mixed with abrasive grains.

It is preferable that the ventilation holes formed through the above-mentioned have a diameter of about 3 to 5 mm and the intervals of adjacent ventilation holes be set to about 5 to 20 mm. Further, it is preferable that the ventilation holes pass through at least the abrasive member.

In the soft polishing disc with holes of the present invention, it is preferable that the abrasive pieces be radially disposed while being partially stacked so as to remain recessed portions.

It is preferable that the length of the lateral portion of each of the abrasive pieces, which are disposed around the circumference of the inside diameter of the ring portion, be $\frac{1}{8}$ to $\frac{1}{12}$ of the circumference of the inside diameter of the ring portion and that the length of the longitudinal portion of each of the abrasive pieces, which are disposed a long a radial direction of the ring portion, be longer than the radial length of the ring portion by about 0 to 3 mm.

It is preferable for the purpose of improving safety that the abrasive member be formed such that the lateral portions of the abrasive pieces are bonded along the tangential lines of the circumference of the inside diameter of the ring portion, that the longitudinal portions thereof be bonded in the radial directions of the ring portion as well as 3 to 10 abrasive pieces are stacked in the thickness direction of the ring portion and that the stacked portions of the abrasive pieces have an overlap width of about 1 to 5 mm.

It is preferable that the material of the back sheet be a glass fiber reinforced phenol laminated sheet having a napped or irregular surface so as to have an increased coupling force with the abrasive pieces. It is also preferable that the glass fiber reinforced phenol laminated sheet is mixed with abrasive grains so as to provide the back sheet with a polishing ability.

Further, according to the present invention, a method of manufacturing a soft polishing disc with holes usable for grinding and polishing a workpiece, comprising: a back sheet mounted on a rotary tool and rotated thereby, and an abrasive member composed of abrasive pieces that are disposed radially on a ring portion having an outside diameter and an inside diameter from the center of the ring thereof and bonded to each other; the method comprising the steps of:

disposing the abrasive pieces each composed of a sand paper together with a thermosetting resin held therebetween in a predetermined pattern while partially stacking them, coupling the abrasive pieces with each other and hardening them for about 1 to 10 hours at a temperature of about 80 to 200° C. at a pressure of about 10 to 100 kgf/cm$^3$, and laminating and bonding the abrasive pieces to the back sheet and forming ventilation holes through at least the abrasive pieces. It is also preferable that the thermosetting resin be mixed with abrasive grains.

Further, it is preferable that the abrasive pieces be bonded to the back sheet by being baked using a one liquid type epoxy resin for 3 hours at a temperature of about 80° C.

DETAILED DESCRIPTION OF THE PREFERRED EMBODIMENTS

A soft polishing disc with holes of the present invention will be described below with reference to the accompanying drawings.

Figure 1:
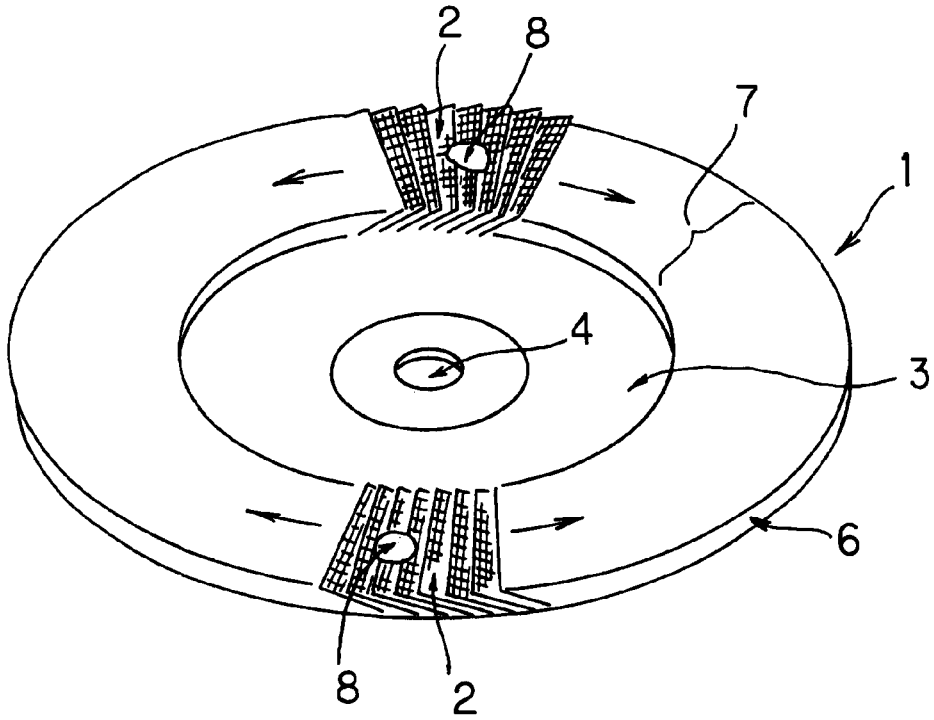
FIG. 1 is a perspective view showing a surface on the side of an abrasive member of an embodiment of a soft polishing disc with holes according to the present invention.
Figure 2A:
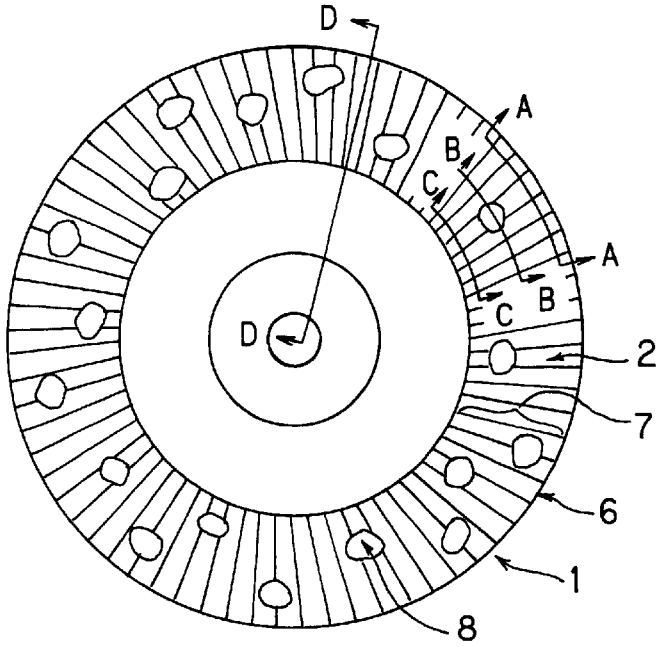
FIGS. 2(*a*)–2(*e*) show the embodiment of the soft polishing disc with holes according to the present invention, wherein FIG. 2(*a*) is a plan view of the surface on the side of the abrasive member of the soft polishing disc with holes, FIG. 2(*b*) is a front elevational view of the abrasive member, FIG. 2(*c*) is a sectional view taken along the A—A of FIG. 2(*a*), FIG. 2(*d*) is a sectional view taken along the line B—B of FIG. 2(*a*), and FIG. 2(*e*) is a sectional view taken along the line C—C of FIG. 2(*a*)
Figure 2B:
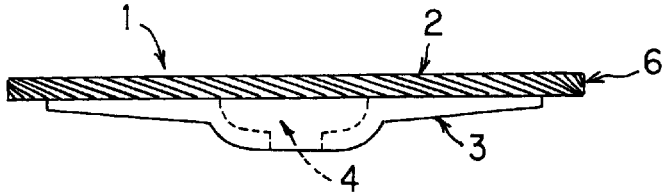
Figure 2C:
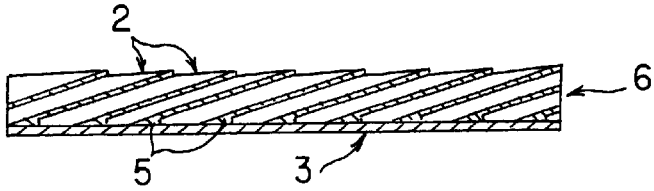
Figure 2D:
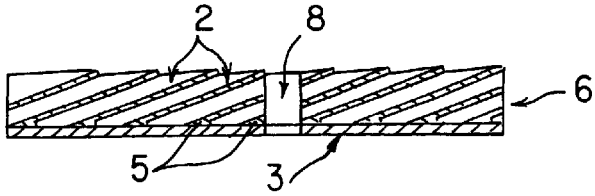
Figure 2E:
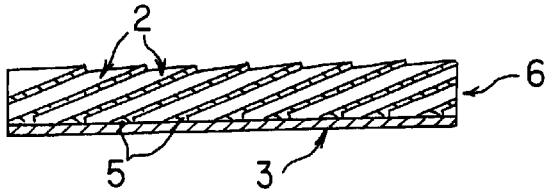
Figure 3:
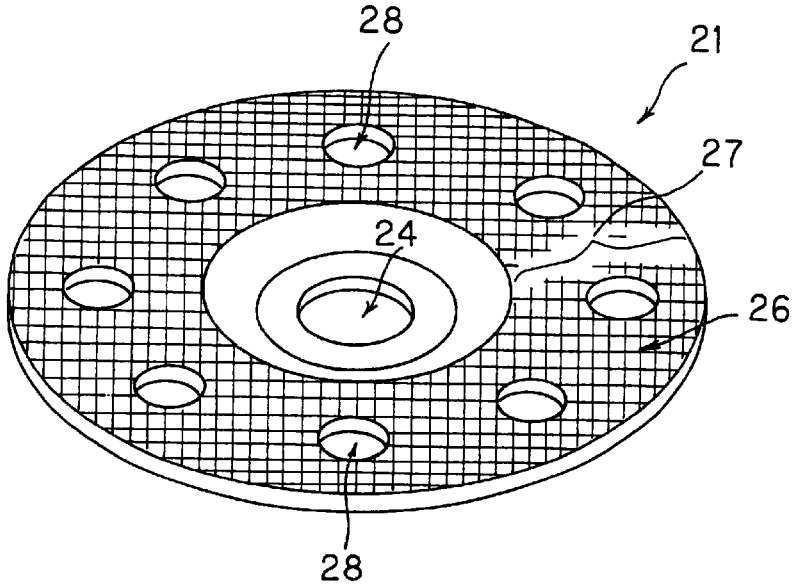
FIG. 3 is a perspective view showing a surface on the side of an abrasive member of an embodiment of a conventional polishing disc.

FIG. 1 is a perspective view showing a surface on the side of an abrasive member of an embodiment of the soft polishing disc with holes according to the present invention. The soft polishing disc with holes 1 is composed of a back sheet 3 that is mounted on a rotary tool such as a grinder or the like through a shaft hole 4 and rotated thereby and an abrasive member 6 composed of abrasive pieces 2 that are radially disposed from the center of the ring of a ring portion 7 and bonded with each other. The soft polishing disc with holes 1 is rotated by the rotary tool such as the grinder or the like at a rotational speed of 10000 rpm so as to perform grinding and polishing.

In the present invention, the abrasive member 6, which employs a sand paper composed of a flexible base cloth on which abrasive grains are coated as the material of the abrasive pieces 2 and a thermosetting resin as a coupling agent for bonding the abrasive pieces 2 with the base cloth and which is obtained by radially disposing the abrasive pieces 2 while partially stacked them, has a feature that a plurality of ventilation holes 8 are formed therethrough at predetermined intervals.

Since the abrasive member 6, which is in contact with a workpiece, is made appropriately soft by the above arrangement, it moderately wears while polishing the workpiece. As a result, the disc is in soft contact with the workpiece, an amount of generated heat is reduced, and the occurrence of burning is suppressed. Even if the abrasive member 6 wears by itself, since the unworn surface thereof appears one after another, it continues grinding while being in contact with the workpiece. This is because that the abrasive member 6 includes the abrasive pieces 2 each composed of the sand paper and radially disposed while being partially stacked.

Figure 4A:
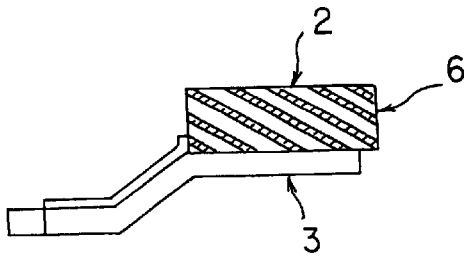
FIG. 4 shows the embodiment of the soft polishing disc with holes according to the present invention, wherein FIG. 4(*a*) shows a sectional view taken along the line D—D of FIG. 2(*a*) before the disc is used, and FIG. 4(*b*) is a sectional view taken along the line D—D of FIG. 2(*a*) after the disc is used.
Figure 4B:
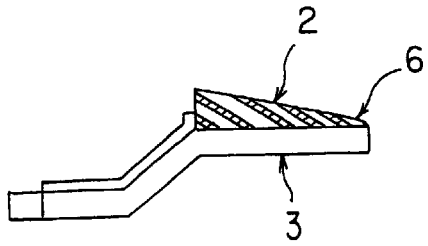

FIG. 4(*a*) is a sectional view of the soft polishing disc with holes 1 before it is used for grinding, and FIG. 4(*b*) is a sectional view thereof after it is used for grinding. To provide a polishing ability with the back sheet 3, almost all the portions of the abrasive pieces 2 that constitute the abrasive member 6 are used for polishing near to the surface of the back sheet 3, thus the abrasive pieces 2 are not wastefully used and are advantageous in cost. In addition, since the abrasive pieces 2 are in soft contact with the workpiece, an auxiliary effect can be achieved in that vibration and noise are reduced in a polishing job.

The use of the thermosetting resin as the coupling agent for bonding the abrasive pieces 2 with each other prevents the exfoliation and the division into parts of the abrasive pieces 2 even if the temperature of them is increased by the heat resulting from the rotation of the abrasive pieces 2 at a high rotational speed exceeding 10000 rpm. Further, the strong bonding of the back sheet 3 to the abrasive pieces 2, which will be described later, enables a polishing job to be carried out stably and a time is not consumed in maintenance.

Further, even the above-mentioned soft and self-wearing abrasive member 6 can discharge polished chips well because the ventilation holes 8 are formed through the abrasive member 6 at a density higher than that of a conventional polishing disc as well as can effectively suck and exhaust air. As a result, the abrasive member 6 can maintain a cooling effect for a long period of time and does not cause burning by preventing radiation by being loaded with chips. It is sufficient for the ventilation holes 8 to pass through the abrasive member 6. However, it is preferable for them also to pass through the back sheet 3 because this arrangement makes it more easy to prevent loading and to increase a cooling effect.

In FIG. 1, the abrasive pieces 2 are radially disposed while being stacked in a pattern having revealed recessed portions in the ring portion 7. Each abrasive piece 2 partially overlaps an adjacent piece 2 so as to reveal an exposed portion of the adjacent piece 2. Each exposed portion is a revealed recessed portion. As a result, when the soft polishing disc with holes 1 is rotated at a high rotational speed in grinding, air flows from the center of the ring portion 7 to the outside, which increased the cooling effect and burning also can be prevented thereby.

The abrasive pieces 2 are composed of the sand paper as described above, and the grade of roughness of the sand paper can be selected from the range of about #30 to about #1000depending on a workpiece to be polished and on a degree of finished quality thereof. Thus, the soft polishing disc with holes 1 can be applied in a wide range of machining from rough grinding to finish polishing. Since the abrasive member 6 wears by itself, it is preferable that the abrasive pieces 2 that constitute the abrasive member 6, that is, the base cloth of the sand paper also be composed of a material that softly wears. However, a nylon sheet that is melt by heat is not preferable. A most popular base cloth is paper, and cotton and the like also can be used as the base cloth.

FIGS. 2(*a*)–2(*e*) show the embodiment of the soft polishing disc with holes 1 according to the present invention, wherein FIG. 2(*a*) is a plan view on the side of the abrasive member, and FIG. 2(*b*) is a front elevational view of the abrasive member. As described above, the abrasive pieces 2 that constitute the abrasive member 6 are disposed on the back sheet 3 radially from the center of the ring of the ring portion 7 while being partially stacked, and the plurality of ventilation holes 8 are formed through the abrasive member 6 at predetermined intervals in the number larger than that of the conventional polishing disc. Adhesive layer 5 is located between back sheet 3 and each abrasive piece 2. It is preferable that the ventilation holes 8 have a diameter of about 3 to 5 mm, and intervals between adjacent ventilation holes 8 are preferably set to about 5 to 20 mm. The diameter of the ventilation holes 8 and the intervals at which they are disposed can be determined depending on a workpiece to be polished and on the grade of the roughness of the sand paper to be used that represents the roughness of the abrasive member. For example, when it is anticipated that a little larger polished chips are produced in a small amount, the ventilation holes 8 are disposed at intervals of 20 mm with a diameter set to 5 mm, whereas when it is anticipated that fine polished chips are produced in a large amount, the ventilation holes 8 are disposed at intervals of 10 mm with a diameter set to 3 mm.

The back sheet 3 is composed of a glass fiber reinforced phenol laminated sheet having an irregular surface and strongly bonded to the abrasive pieces 2 using a one liquid type epoxy resin at a temperature of about 80° C. while being baked for about 3 hours. Accordingly, even if the soft polishing disc with holes 1 is rotated at a high rotating speed of at least 10000 rpm, the abrasive member 6 composed of the abrasive pieces 2 is not exfoliated from the back sheet 3, whereby polishing can be carried out stably.

FIGS. 2(*c*) to 2(*e*) show partial sectional views of the abrasive pieces 2 of the soft polishing disc with holes 1 shown in FIG. 2(*a*), wherein FIG. 2(*c*) shows a sectional view taken along the line A—A of FIG. 2(*a*), FIG. 2(*d*) is a sectional view taken along the line B—B of FIG. 2(*a*) and shows a portion where the ventilation holes 8 are formed, and FIG. 2(*e*) is a sectional view taken along the line C—C of FIG. 2(*a*). The detailed size of each of the abrasive pieces 2 is such that the length of the lateral portion of the abrasive piece disposed around the circumference of the inside diameter of the ring portion 7 is appropriately ⅛ to 1/12 of the circumference of the inside diameter of the ring portion 7 and that the length of the longitudinal portion of the abrasive piece, which is disposed along a radial direction of the ring portion 7, is appropriately longer than the radial length of the ring portion 7 by about 0 to 3 mm.

The abrasive pieces 2 are disposed radially from the center of the ring of the ring portion 7 as described above. To describe this in more detail, the lateral portions of the abrasive pieces 2 are bonded along the tangential lines of the circumference of the inside diameter of the ring portion 7 and the longitudinal portions thereof are bonded in the radial directions of the ring portion 7. In addition, 3 to 10 abrasive pieces 2 are stacked in the thickness direction of the ring portion 7 so as to have an overlap width of about 1 to 5 mm.

When, for example, a soft polishing disc with holes 1 having a diameter of 100 mm was manufactured by stacking 4 abrasive pieces 2, which had a lateral portion of 18 mm and a longitudinal portion of 25 mm, in a thickness direction with an overlap width of 3 mm, an excellent, stable and durable polishing ability could be obtained.

The abrasive pieces 2 each composed of the sand paper are manufactured by being coupled with each other and hardened together with a thermosetting resin at a temperature of 80 to 200° C. at a pressure of 10 to 100 kgf/cm$^3$ for 1 to 10 hours so that they are integrated with each other. Note that, in more preferable coupling and hardening conditions, the temperature is set to 100 to 150° C., the pressure is set to 10 to 50 kgf/cm$^3$ and the time is set to 2 to 6 hours.

Further, the abrasive member 6 having the abrasive grains between the abrasive pieces 2 can be obtained by subjecting the abrasive pieces 2 to coupling and hardening processing using the thermosetting resin mixed with the abrasive grains. Since the soft polishing disc with holes 1 using the thus obtained abrasive member 6 has an improved polishing ability, it is preferable to mix the abrasive grains with the thermosetting resin. Note that the thickness of the abrasive pieces 2 to be used, that is, the thickness of the sand paper is set to about 0.5 to 1.5 mm.

As described above, the thermosetting resin whose hardening reaction is proceeded by heat is used as the coupling agent for integrating the abrasive pieces 2 with each other. The abrasive member 6 is manufactured as a very strong molded member by a resin that has fluidity before it is cured and preferably contains abrasive grains. Used as the types of the thermosetting resin are melamine resin, silicon resin, phenol resin, and urea resin that are cured by a polycondensation reaction, and epoxy resin, acrylic resin, etc. that are cured by a polyaddition reaction.

While the present invention will be described below in detail based on the following examples, it is by no means limited thereto.

EXAMPLE 1

A test was carried out using the soft polishing discs with holes of the present invention. A sand paper #100 composed of a paper of 1.5 mm thick was used for abrasive pieces. Each of the discs was arranged such that a ring portion had an outside diameter of 50 mm and an inside diameter of 15 mm, 80 abrasive pieces having a lateral portion of 20 mm and a longitudinal portion of 25 mm were radially disposed so that 4 abrasive pieces were stacked in a thickness direction. Ventilation holes each having a diameter of 5 mm were alternately formed perfectly passing through an abrasive member and a back sheet at positions near to the outer circumstance of the ring portion and at positions near to the inner circumference thereof so that intervals of 20 mm were secured between the nearest ventilation holes.

5 types of soft and hard metal workpieces, that is, workpieces of cast iron, steel, stainless steel, copper, aluminum were prepared and polished by the disc at a rotating speed from 5000 rpm to 10000 rpm. Workpieces that were well polished at 10000 rpm were accepted, and workpieces that were not polished well were rejected. The polished state of the workpieces was evaluated in four ratings as to the categories of an air suck and exhaust property, ventilation property, radiation property, burning prevention property, durability regardless of that they were accepted or rejected. The evaluation was made by good "◎", fairly good "○", bad "x", and hard to say which "Δ". Table 1 shows a result of the test. In addition to the above test, a destructive test was carried out at a rotating speed up to 25000 rpm.

EXAMPLE 2

A sand paper #400 composed of a paper of 1.5 mm thick was used for abrasive pieces. Each of discs was manufactured in such a manner that 80 abrasive pieces were prepared and radially disposed, and ventilation holes each having a diameter of 4 mm were alternately formed perfectly passing through an abrasive member and a back sheet at positions near to the outer circumstance of the ring portion and at positions near to the inner circumference thereof so that intervals of 15 mm were secured between the nearest ventilation holes, and a test was carried out using the disc. The other conditions of the test were set similarly to those of the example 1. Table 1 shows a result of the test.

EXAMPLE 3

A sand paper #1000 composed of a paper of 1.5 mm thick was used for abrasive pieces. Each of disks were manufactured in such a manner that 80 abrasive pieces, which were a little smaller than those of the example 1 with a lateral length of 15 mm and a lengthwise length of 15 mm were prepared and radially disposed, and ventilation holes each having a diameter of 5 mm were alternately formed perfectly passing through an abrasive member and a back sheet at positions near to the outer circumstance of the ring portion and at positions near to the inner circumference thereof so that intervals of 20 mm were secured between the nearest ventilation holes. Then, a test was carried out using the discs. The other conditions were set similarly to those of the example 1. Table 1 shows a result of the test.

Comparative Example 1

A test was carried out using offset type resinoid grindstones as discs. The other conditions of the test were set similarly to those of the example 1. Table 1 shows a result of the test.

Comparative Example 2

A test was carried out using offset type flexible grindstones as discs. The other conditions of the test were set similarly to those of the example 1. Table 1 shows a result of the test.

Comparative Example 3

A test was carried out using discs without ventilation holes each composed an ordinary flap disc grindstone (having the structure in which abrasive pieces each composed of a sand paper are radially disposed while being partially stacked). The other conditions of the test were set similarly to those of the example 1. Table 1 shows a result of the test.

Comparative Example 4

A test was carried out using synthetic resin flap discs composed of synthetic resin sheets of urethane that are mixed with abrasive grains and disposed radially so as to form recessed portions. The other conditions of the test were set similarly to those of the example 1. Table 1 shows a result of the test.

(Consideration)

As a result of consideration, only the soft polishing disc with holes of the present invention could withstand the rotational speed of 25000 rpm. The discs used in the example 3, which had the small abrasive pieces and the large ventilation holes disposed densely, exhibited a most outstanding polishing performance in other test. However, a cooling ability achieved by the ventilation holes, that is, a burning prevention ability could be confirmed in any of the three examples using the soft polishing disc with holes of the present invention. The soft polishing disc with holes of the present invention could stably continue the polish of the softer aluminum sheets and copper sheets without being loaded with chips. It could be reconfirmed that while the 4 conventional examples exhibited a polishing performance similar to that of the soft polishing disc with holes of the present invention at the beginning of polishing, they caused burning instantly due to bad radiation and the polishing performance thereof was gradually lowered by being loaded with chips.

TABLE 1

| | Disc of the Invention | | | Comparative Disc | | | |
|---|---|---|---|---|---|---|---|
| | Example 1 | Example 2 | Example 3 | Comparative Example 1 | Comparative Example 2 | Comparative Example 3 | Comparative Example 4 |
| Result of test | Passed | Passed | Passed | Rejected | Rejected | Rejected | Rejected |
| Air suck and exhaust property | ◎ | ◎ | ◎ | X | X | X | X |
| Ventilation property | ◎ | ◎ | ◎ | X | X | X | Δ |

TABLE 1-continued

| | Disc of the Invention | | | Comparative Disc | | | |
|---|---|---|---|---|---|---|---|
| | Example 1 | Example 2 | Example 3 | Comparative Example 1 | Comparative Example 2 | Comparative Example 3 | Comparative Example 4 |
| Radiation property | ◎ | ◎ | ◎ | X | X | Δ | X |
| Burning prevention property | ◎ | ◎ | ◎ | X | X | X | Δ |
| Durability | Δ | ○ | ◎ | ○ | Δ | X | X |
| Safety | ○ | ○ | ◎ | ◎ | ○ | Δ | Δ |
| Polishing ability | ◎ | ◎ | ◎ | Δ | Δ | ○ | Δ |

As described above, according to the soft polishing disc with holes of the present invention, there can be achieved such an outstanding effect that the soft polishing disc is excellent in the suck and exhaust of air when a polishing and grinding job is carried out, that is, it is excellent in ventilation and difficult to cause loading with chips, suppresses the occurrence of burning because an abrasive surface is excellent in a heat removing property and that the disc has high versatility, that is, hard workpieces as well as soft workpieces can be stably ground and polished by only one kind of the disc.

What is claimed is:

1. A soft polishing disc with holes usable for grinding and polishing a workpiece, comprising:

a back sheet including a ring portion having an outside diameter and an inside diameter for mounting on a rotary tool and being rotated thereby, and an abrasive member comprising a plurality of abrasive pieces, an exposed piece of each piece extending radially, said pieces arranged in a pattern on said ring portion and bonded to each other, wherein each of said abrasive pieces comprises a sand paper portion, adjacent abrasive pieces are bonded to each other by a thermosetting resin, and said abrasive member includes a plurality of ventilation holes at predetermined intervals.

2. A soft polishing disc with holes according to claim 1, wherein the grade of roughness of said sand paper is about #30 to #1000.

3. A soft polishing disc with holes according to claim 1, wherein the base cloth of said sand paper is selected from the group consisting of cotton and paper.

4. A soft polishing disc with holes according to claim 1, wherein said thermosetting resin is selected from the group consisting of melamine resin, silicon resin, phenol resin, urea resin cured by a polycondensation reaction and epoxy resin, acrylic resin, cured by a polyaddition reaction.

5. A soft polishing disc with holes according to claim 1, wherein said thermosetting resin is mixed with abrasive grains.

6. A soft polishing disc with holes according to claim 1, wherein each of said ventilation holes has a diameter of about 3 to 5 mm and the intervals of adjacent ventilation holes are about 10 to 20 mm.

7. A soft polishing disc with holes according to claim 1, wherein said ventilation holes pass through at least said abrasive member.

8. A soft polishing disc with holes according to claim 1, wherein said abrasive pieces are stacked to reveal recessed portions between adjacent abrasive pieces.

9. A soft polishing disc with holes according to claim 1, wherein each of said abrasive pieces includes a lateral portion circumferentially located at the inside diameter of said ring portion, said lateral portion having a length of ⅛ to 1/12 of the circumference of said inside diameter, and each of said abrasive pieces includes a longitudinal portion located along a radial direction of said ring portion, said longitudinal portion having a length longer than the radial length of said ring portion by about 0 to 3 mm.

10. A soft polishing disc with holes according to claim 9, wherein:

each said lateral portion is bonded along tangential lines of the circumference of the inside diameter of said ring portion, each said longitudinal portion is bonded to an adjacent longitudinal portion in the radial direction of said ring portion, wherein 3 to 10 abrasive pieces are stacked in the thickness direction of said ring portion; and the stacked portions of said abrasive pieces have an overlap width of about 1 to 5 mm.

11. A soft polishing disc with holes according to claim 1, wherein the material of said back sheet is a glass fiber reinforced phenol laminated sheet having an irregular surface for increasing a coupling force with said abrasive pieces.

12. A soft polishing disc with holes according to claim 11, wherein said glass fiber reinforced phenol laminated sheet is mixed with abrasive grains so as to provide said back sheet with a polishing ability.

13. A method of manufacturing a soft polishing disc with holes usable for grinding and polishing a workpiece, said disc including a back sheet including a ring portion having an outside diameter and an inside diameter for mounting on a rotary tool and being rotated thereby, and an abrasive member comprising a plurality of abrasive pieces, an exposed free edge of each piece extending radially on said ring portion and bonded to each other; the method comprising the steps of:

disposing in a predetermined pattern having revealed recessed portions stacked abrasive pieces each composed of sand paper;

said adjacent pieces being bonded together with a thermosetting resin held therebetween;

coupling said abrasive pieces with each other and hardening them for about 1 to 10 hours at a temperature of about 80 to 200° C. at a pressure of 100 kgf/cm$^3$; and laminating and bonding said abrasive pieces to a back sheet and forming ventilation holes through at least said abrasive pieces.

14. A method of manufacturing a soft polishing disc with holes according to claim 13, wherein said thermosetting resin is mixed with abrasive grains.

15. A method of manufacturing a soft polishing disc with holes according to according to claim 13, wherein the step of laminating and bonding said abrasive pieces to said back sheet comprises interposing liquid type epoxy resin between said abrasive pieces and said back sheet to form an assembly and baking the assembly for 3 hours at a temperature of about 80° C.

* * * * *